US010578250B2

(12) United States Patent
Lamiable et al.

(10) Patent No.: US 10,578,250 B2
(45) Date of Patent: Mar. 3, 2020

(54) HAND-WHEEL ADJUSTING THE OUTLET OF A TAP FOR GAS CYLINDER

(71) Applicant: Luxembourg Patent Company S.A., Lintgen (LU)

(72) Inventors: Morgan Lamiable, Metzervisse (FR); Jean-Claude Schmitz, Heisdorf (LU)

(73) Assignee: LUXEMBOURG PATENT COMPANY S.A., Luxembourg (LU)

( * ) Notice: Subject to any disclaimer, the term of this patent is extended or adjusted under 35 U.S.C. 154(b) by 0 days.

(21) Appl. No.: 15/776,687

(22) PCT Filed: Nov. 14, 2016

(86) PCT No.: PCT/EP2016/077565
§ 371 (c)(1),
(2) Date: May 16, 2018

(87) PCT Pub. No.: WO2017/085006
PCT Pub. Date: May 26, 2017

(65) Prior Publication Data

US 2018/0356042 A1 Dec. 13, 2018

(30) Foreign Application Priority Data

Nov. 16, 2015 (LU) ..... 92872

(51) Int. Cl.
*F17C 13/04* (2006.01)

(52) U.S. Cl.
CPC ..... *F17C 13/04* (2013.01); *F17C 2201/058* (2013.01); *F17C 2205/0165* (2013.01);
(Continued)

(58) Field of Classification Search
CPC ..... F17C 13/04; F17C 2201/058; F17C 2223/0123; F17C 2223/035;
(Continued)

(56) References Cited

U.S. PATENT DOCUMENTS 430,774 A * 6/1890 Hamilton ..... H01H 3/125 400/495
1,846,476 A * 2/1932 Degenhart ..... G05G 1/06 40/331
(Continued)

FOREIGN PATENT DOCUMENTS

WO 2008052022 A2 5/2008
WO 2008149312 A1 12/2008
(Continued)

OTHER PUBLICATIONS

International Search Report for corresponding PCT/EP2016/077565 dated Jan. 1, 2017.

*Primary Examiner* — Benjamin R Shaw
(74) *Attorney, Agent, or Firm* — Sandberg Phoenix & von Gontard PC

(57) ABSTRACT

The invention is directed to a hand-wheel for adjusting an outlet pressure and/or a flow-rate of a tap for a gas cylinder, the hand-wheel comprising a body; and a transparent cover fixed on the body. The hand-wheel further comprises indicia arranged between the transparent cover and the body so as to be visible by a user but not in contact with the fingers of the user. The invention is also directed to a tap for gas cylinder, comprising such a hand-wheel, as well as to a tap assembly comprising such a tap and a cover housing the tap.

15 Claims, 2 Drawing Sheets

(52) U.S. Cl.
CPC ..... *F17C 2205/0308* (2013.01); *F17C 2205/0329* (2013.01); *F17C 2205/0338* (2013.01); *F17C 2223/0123* (2013.01); *F17C 2223/035* (2013.01); *F17C 2250/043* (2013.01); *F17C 2250/0486* (2013.01); *F17C 2250/0626* (2013.01); *F17C 2250/0636* (2013.01); *F17C 2265/04* (2013.01); *F17C 2270/02* (2013.01); *F17C 2270/0745* (2013.01)

(58) Field of Classification Search
CPC ..... F17C 2250/043; F17C 2250/0486; F17C 2250/0626; F17C 2250/0636; F17C 2265/04; F17C 2270/02; F17C 2270/0745
USPC ..... 222/3; 40/331; 116/284, 298, 303, 306
See application file for complete search history.

(56) References Cited

U.S. PATENT DOCUMENTS 1,867,292 A * 7/1932 Weatherhead, Jr. ..... G05G 1/02 40/331
1,918,243 A * 7/1933 Bergaud ..... B65D 39/16 40/311
1,986,409 A * 1/1935 Redmer ..... B65D 35/32 222/99
1,993,938 A * 3/1935 McDonald ..... A45D 33/26 16/111.1
2,078,567 A * 4/1937 Foregger ..... F16K 1/302 222/3
2,376,305 A * 5/1945 Bauer ..... G09F 7/165 428/68
2,414,113 A * 1/1947 Mapes ..... G01N 3/12 73/49.8
2,793,504 A * 5/1957 Webster ..... G05D 16/10 137/322
2,819,698 A * 1/1958 Berndt ..... H03J 1/14 116/295
2,835,218 A * 5/1958 Walsh ..... B62D 15/02 116/31
RE24,999 E * 6/1961 Kirsten ..... H03J 1/14 116/286
2,987,032 A * 6/1961 Kirsten ..... G05G 1/015 116/292
3,024,555 A * 3/1962 Abeles ..... E05B 1/0007 40/331
3,190,496 A * 6/1965 Weiland, Jr. ..... F16K 1/307 222/3
3,193,625 A * 7/1965 Triplett ..... H04M 1/22 379/367
3,313,057 A * 4/1967 Leddy ..... G05G 1/10 40/331
3,430,377 A * 3/1969 Ellison ..... F16K 31/60 40/332
4,309,828 A * 1/1982 Sakamoto ..... G01C 17/18 116/284
4,465,209 A * 8/1984 Wilder ..... B67D 7/426 141/390
4,608,882 A * 9/1986 Howie, Jr. ..... B23P 11/00 74/548
4,706,929 A * 11/1987 Kalaskie ..... F16K 1/305 137/316
4,846,094 A * 7/1989 Woods ..... B60Q 1/22 116/31
5,058,758 A 10/1991 Suddeth
5,092,477 A * 3/1992 Johnson, Jr. ..... B65D 55/066 215/220
5,158,324 A * 10/1992 Flesher ..... B60J 11/06 280/770
5,499,427 A * 3/1996 Bowman ..... A47B 95/02 16/417
6,062,438 A * 5/2000 Ellis ..... A47F 1/035 198/671
6,112,619 A * 9/2000 Campbell ..... F16K 31/60 116/277
6,242,064 B1 * 6/2001 Howie, Jr. ..... A44B 1/06 150/155
6,463,630 B1 * 10/2002 Howie, Jr. ..... G05G 1/10 16/441
6,994,025 B1 * 2/2006 Faber ..... B41K 1/40 101/104
7,963,003 B1 * 6/2011 Keene ..... F24C 15/086 16/441
2004/0038758 A1 * 2/2004 Guenther ..... A63B 60/00 473/457
2004/0045608 A1 * 3/2004 Peters ..... F16K 31/60 137/552.7
2004/0144179 A1 * 7/2004 Ratner ..... A61B 5/09 73/715
2006/0060251 A1 * 3/2006 Gamard ..... F16K 1/305 137/613
2007/0069090 A1 * 3/2007 Driscoll ..... A47B 95/02 248/206.5
2008/0095607 A1 4/2008 Hagstrom et al.
2009/0050218 A1 * 2/2009 Burgess ..... F17C 13/06 137/557
2009/0121168 A1 * 5/2009 Muzzo ..... F16K 1/302 251/89.5
2010/0229959 A1 * 9/2010 Boyer ..... F17C 13/04 137/116.3
2015/0021503 A1 * 1/2015 Schmitz ..... F16K 31/528 251/129.03
2015/0247589 A1 * 9/2015 Lambert ..... F16K 37/0025 137/554
2015/0260346 A1 * 9/2015 Ligonesche ..... F17C 1/00 206/0.6
2017/0016575 A1 * 1/2017 Lamiable ..... F17C 13/04
2017/0067601 A1 * 3/2017 Lamiable ..... F17C 13/002

FOREIGN PATENT DOCUMENTS

WO 2015132092 A2 9/2015
WO 2015132285 A1 9/2015

* cited by examiner

HAND-WHEEL ADJUSTING THE OUTLET OF A TAP FOR GAS CYLINDER

CROSS-REFERENCE TO RELATED APPLICATIONS

The present invention is the US national stage under 35 U.S.C. § 371 of International Application No. PCT/EP2016/077565, which was filed on Nov. 14, 2016, and which claims the priority of application LU 92872 filed on Nov. 16, 2015, the content of which (text, drawings and claims) are incorporated here by reference in its entirety.

FIELD

The invention is directed to the field of taps for compressed gas, more particularly for gas cylinders. Such taps can feature various functions like a shut-off function, a pressure reducing function, a flow-selection function, etc.

BACKGROUND

Prior art patent document published WO 2015/132092 A2 discloses a cover for a gas cylinder tap. The cover comprises a shell for housing the tap and a hook pivotally mounted on the shell, the hook being configured for securing the gas cylinder to a horizontal bar, like a bar of a hospital bed. The shell comprises reservations on its external surface configured for receiving the hook in a folded position so as to generally conform to said external surface. The invention is also directed to a gas storage assembly comprising a gas cylinder, a tap and a cover. The shell comprises an upper half-shell and a lower half-shell joined together. The tap comprises a pressure reducer and a rotatable hand-wheel for actuating a flow-selector, said hand-wheel being on the upper half-shell. The tap comprises also an outlet connector of the hose barb type extending through an opening of the upper half-shell.

Prior art patent document published WO 2015/132285 A1 discloses a device for regulating the pressure and/or flow of pressurized gas, comprising a body with a gas inlet, a gas outlet and a gas passage the outlet with the inlet, a pressure reducer and a flow-selector arranged downstream of the pressure reducer, a hand-wheel rotatably mounted on the body and cooperating with the flow-selector for adjusting said flow, and a pressure indicator located at the centre of the hand-wheel. The device comprises also a shaft rigidly fixed to the body and rotatably bearing the hand-wheel, said shaft supporting the flow-selector and comprising a gas channel fluidly connected to the gas passage in the body.

None of the above mentioned teachings discloses details about the hand-wheel, in particular about possible indicia providing reference marks for its angular position. For most applications, in particular for medical applications, the outlet pressure and/or flow-rate is a critical information for a proper use.

Indicia are often printed on the outer surface of the hand-wheel. That surface is often of a dark colour and the indicia are often printed in white for providing contrast. Further to a repetitive use of the tap, the indicia can wear out and almost disappear, potentially leading to the delivery of a not adapted flow-rate and/or pressure.

SUMMARY

The invention has for technical problem to provide a hand-wheel for a gas cylinder tap that confers a higher readability, security, manipulation comfort and higher modularity.

The invention is directed to a hand-wheel for adjusting an outlet pressure and/or a flow-rate of a tap for a gas cylinder, the hand-wheel comprising: a body; and a transparent cover fixed on the body; wherein the hand-wheel further comprises: indicia arranged between the transparent cover and the body so as to be visible by a user but not in contact with the fingers of the user.

According to various embodiments, the body comprises a front face, at least one of the indicia being arranged on the front face.

According to various embodiments, the front face of the body supporting the at least one indicia forms an annular rim.

According to various embodiments, the transparent cover comprises a front face and a rear face, at least one of the indicia being arranged on the rear face.

According to various embodiments, the indicia are printed on the body and/or the transparent cover, in various instances by screen printing.

Advantageously, the indicia can be on disk or an annulus-shaped plate placed between the body and the cover.

According to various embodiments, the indicia are distributed along a periphery of the hand-wheel.

According to various embodiments, the body comprises a central cavity for housing a gauge or a digital display visible through the transparent cover.

According to various embodiments, the transparent cover is generally disk-shaped with a front face and a rear face, the cover comprising on the rear face at least two bosses configured for receiving threaded portions of fastening screws engaged through holes in the body, from a rear face of the body.

According to various embodiments, the body comprises recesses receiving the bosses of the transparent cover, respectively.

According to various embodiments, the transparent cover comprises on the front face of the cover ribs extending radially, each boss on the rear face of the cover being located in front of one of the ribs.

According to various embodiments, the transparent cover comprises at its periphery an annular portion that encircles the body. That annular portion can extend as a cylindrical portion along the rotation axis of the hand-wheel.

According to various embodiments, it comprises a gasket, in various instances of the O-ring type, extending between the body and the transparent cover at the periphery of the hand-wheel.

The invention is also directed to a tap for gas cylinder comprising: a body with an inlet, an outlet and a passage connecting the inlet with the outlet; a device in the passage for varying the pressure and/or flow-rate at the outlet, the device comprising a rotating element for adjusting the pressure and/or flow-rate; a hand-wheel mounted on the rotating adjusting element of the device; wherein the hand-wheel is according to the invention.

According to various embodiments, the rotating element of the device is supported by a fixed shaft, and the tap further comprises an electronic indicator with a digital display housed in the cavity of the body of the hand-wheel, and electric wires connected to the indicator and extending through a longitudinal bore in the shaft of the device.

The invention is also directed to a tap assembly comprising: a tap for gas cylinder; and a cover housing the tap; wherein the tap is in accordance with the invention, and the cover comprises an opening receiving the adjusting hand-wheel of the tap and a marking on an outer surface of the cover at the edge of the opening, the marking forming a reference for the indicia of the hand-wheel.

The invention is particularly interesting in that it provides an improved hand-wheel and thereby an improved tap assembly. Indeed, the indicia are hidden behind the transparent cover so that they are never in contact with the fingers of the user of the tap assembly. It is indeed well known that repetitive use of a rotating hand-wheel with indicia printed directly on its outer surface has for effect to progressively wear out these indicia. The absence of indicia can lead to a wrong position of the hand-wheel and thereby a wrong flow-rate or pressure. In addition, the construction of the hand-wheel is particularly interesting because it provides a large display surface and a large gripping surface for the user. The manipulation of the hand-wheel is rendered particularly handy and comfortable.

DRAWINGS

DESCRIPTION

Figure 1:
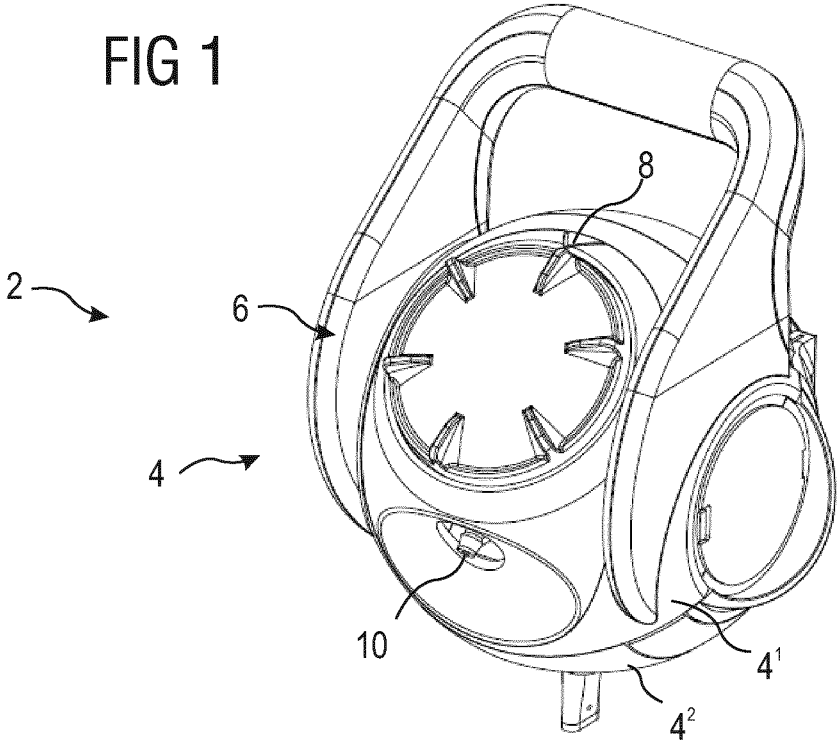
FIG. 1 is a perspective view of a tap assembly with a hand-wheel in accordance with various embodiments of the invention.

FIG. 1 illustrates in perspective a tap assembly in accordance with various embodiments of the invention. The tap assembly 2 comprises, essentially, a tap (not visible) and a cover 4 housing the tap. The cover 4 comprises a generally ball-shaped shell. That shell is constituted, essentially, of an upper half-shell $\mathbf{4}^1$ and a lower half-shell $\mathbf{4}^2$. Both half-shells $\mathbf{4}^1$ and $\mathbf{4}^2$ are joined together along a contact plane that is inclined relative a vertical direction and relative to a horizontal direction. The upper half-shell $\mathbf{4}^1$ comprises an opening that receives a hand-wheel 6 for adjusting the flow-rate of the tap. The outer surface of the upper half-shell $\mathbf{4}^1$ comprises a mark 8, for instance in the form of an arrow, at the edge of the opening, so as to form a reference mark for the angular position of the hand-wheel 6.

The tap comprises an outlet in the form of a hose barb 10 that extends through another opening in the upper half-shell $\mathbf{4}^1$.

Figure 2:
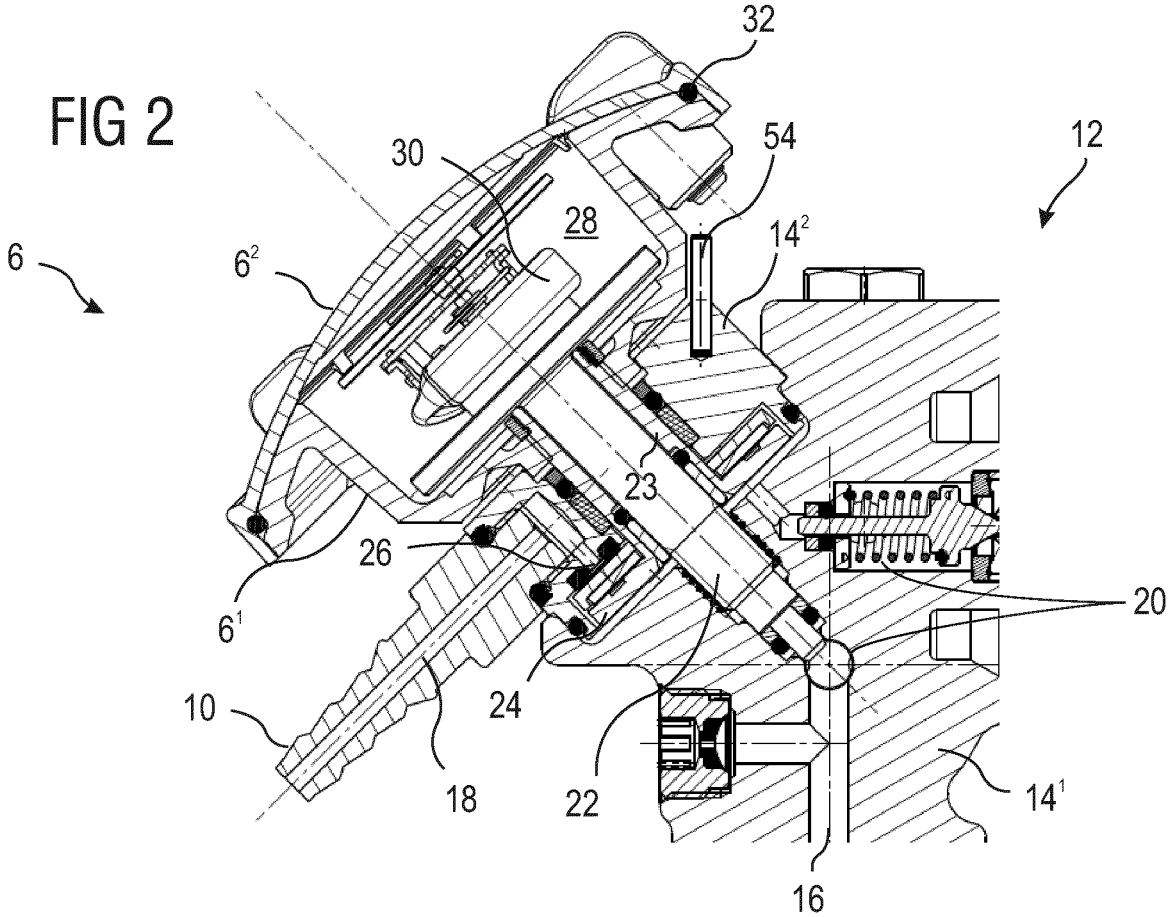
FIG. 2 is a cross-sectional view of the tap of the assembly of FIG. 1, in accordance with various embodiments of the invention.

FIG. 2 is a cross-sectional view along a vertical longitudinal plane of the tap of the tap assembly of FIG. 1. The tap 12 comprises a body $\mathbf{14}^1$ and $\mathbf{14}^2$ with an inlet 16, an outlet 18 and a passage 20 connecting the inlet with the outlet. A pressure reducer (only partly represented at the right cut of the illustration) can be provided for reducing the inlet pressure. Such a pressure reducer is as such well-known in the art.

The tap 12 comprises also the hand-wheel 6 that is mounted on the shaft 22 that is fixedly mounted on the body $\mathbf{14}^1$. The shaft 22 supports a sleeve 23 of a flow-selector 24. The gas downstream of the pressure reducer enters the flow selector 24 before reaching the outlet 18. The flow selector comprises a plate with calibrated holes that are selectively positioned in front of an outlet passage 26 for selecting the flow-rate. The flow-rate directly depends on the cross-section of the calibrated hole that is positioned in front of the outlet passage 26. Such a flow-selector is as such well known.

The hand-wheel 6 comprises a body $\mathbf{6}^1$ and a transparent cover $\mathbf{6}^2$. The body $\mathbf{6}^1$ is generally cup-shaped so as to form a cavity 28 where a status indicator 30 can be housed. For instance, the status indicator is a pressure gauge being understood that it can also be an electronic indicator with a display providing information like the pressure at the inlet, the flow-rate and/or the remaining service time at the current flow-rate. The body $\mathbf{6}^1$ is rotatably attached to the sleeve 23 of the flow-selector 24 so that rotation of the hand-wheel causes a selection of a flow-rate.

In the case of a pressure gauge, the latter can be in fluid connection with the inlet 16 via a bore formed through the shaft 22 until the passage 20 in the tap body $\mathbf{14}^1$. In FIG. 2 such a bore is not visible because the shaft 22 and the pressure gauge 30 are represented in front view, i.e. without any cut.

In the case of an electronic status indicator housed in the cavity 28, electric wires connected to the indicator can extend through a bore formed in the shaft 22 and possibly also in the body $\mathbf{14}^1$ in order to exit the body at an opposite side to the hand-wheel, thereby permitting the wires to be connected to a pressure sensor and/or a power source. In that case, the passage 20 must not fluidly intersect that bore.

As is apparent in FIG. 2, the transparent cover $\mathbf{6}^2$ fits on the body $\mathbf{6}^1$ in various instances via a gasket 32 of the O-ring type for providing a waterproof protection of the status indicator 28.

Figure 3:
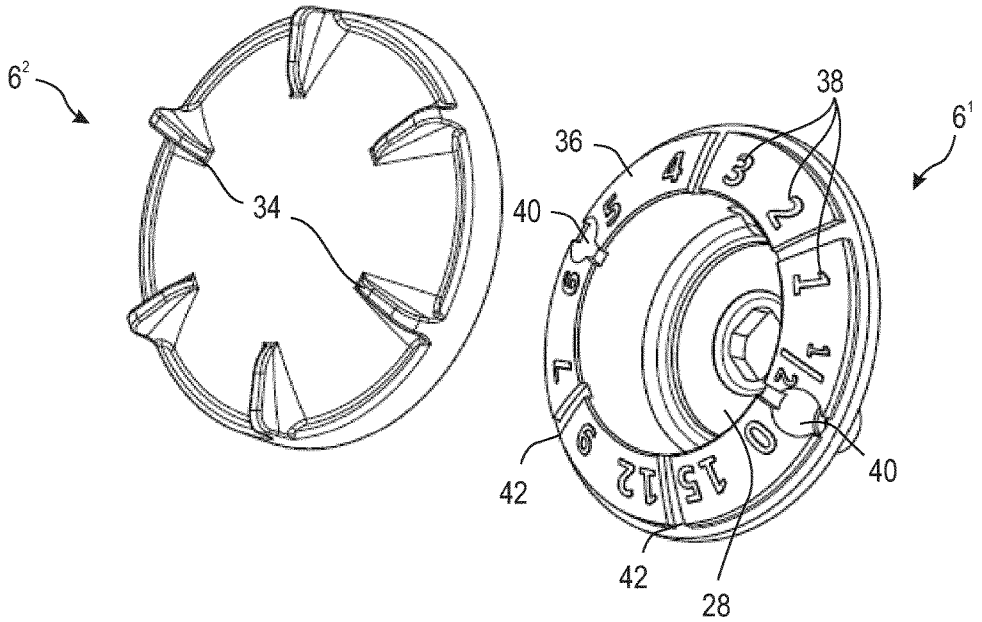
FIG. 3 is an exploded view of the hand-wheel of the tap assembly of FIGS. 1 and 2, in accordance with various embodiments of the invention.

FIG. 3 is an exploded view of the hand-wheel 6. The cover $\mathbf{6}^2$ is generally disk-shaped with a series of ribs 34 extending radially and disposed along the periphery of the cover. The ribs 34 serve as gripping surfaces for the fingers of the user of the tap assembly. The cover is usually made of plastic by injection moulding.

The body $\mathbf{6}^2$ is generally cup-shaped with an outer rim portion 36. That outer rim portion 36 forms a generally annular surface carrying indicia 38. These can be printed, for instance screen printed on that surface. They can be distributed along the whole periphery of the annular surface. When the transparent cover $\mathbf{6}^2$ is placed against the body $\mathbf{6}^2$, it provides a gripping surface by means of the ribs 34 while forming a protection for the indicia and the status indicator housed in the cavity 28. The body $\mathbf{6}^1$ can be made of a material with a dark colour and the indicia can be made of a clear colour, like white, in order to provide contrast. The contrary can also be considered.

Still with reference to FIG. 3, the outer rim portion 36 of the body $\mathbf{6}^1$ comprises circular recesses 40 for receiving corresponding bosses (44 in FIG. 4) on the rear face of the cover $\mathbf{6}^2$. Fastening screws (not represented) can be inserted in the recesses 40 from the rear side of the outer rim portion 36 of the body $\mathbf{6}^1$ to engage with the bosses of the cover $\mathbf{6}^2$. More specifically, the recesses 40 comprise, each, a hole for receiving a shank of a fastening screw whereas the bosses (44, FIG. 4) comprise, each, a preformed hole to be engaged with a threaded portion of the screw.

Still with reference to FIG. 3, the outer rim portion 36 of the body $\mathbf{6}^1$ can also comprises radially extending slots or recesses 42 that engage with corresponding ribs 46 (FIG. 4) on the rear face of the cover $\mathbf{6}^2$.

Figure 4:
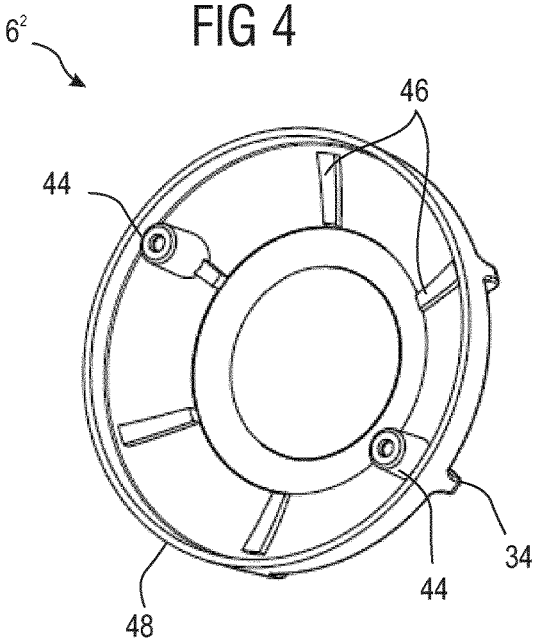
FIG. 4 is a perspective view of the rear side of the cover of the hand-wheel of FIG. 3, in accordance with various embodiments of the invention.

FIG. 4 illustrates the rear face of the cover $\mathbf{6}^2$. It shows the above mentioned ribs 46 engaging with the slots 42 (FIG. 3)

in the outer rim portion 36 of the body $6^1$. It shows also the bosses 44 that engage with the circular recesses 40 (FIG. 3) in the outer rim portion 36 of the body $6^1$. Advantageously, the bosses 44 are positioned in front of the gripping ribs 34 on the front face of the cover. This has for advantage that the bosses and more particularly the fastening screws are less visible, if any.

FIG. 4 illustrates also the outer annular portion 48 that is configured for encircling the outer rim portion 36 (FIG. 3) of the body $6^1$ (FIG. 3).

Figure 5:
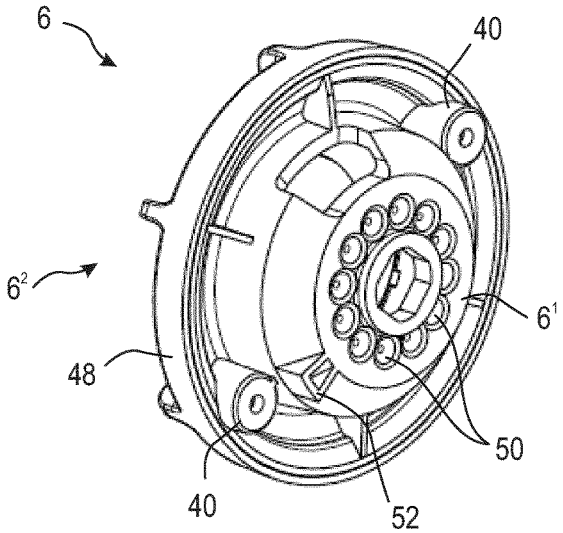
FIG. 5 is a perspective view of the rear side of the hand-wheel of FIG. 3, in accordance with various embodiments of the invention.

FIG. 5 is a rear view of the hand-wheel 6 in its assembled state. The rear face of the body $6^1$ is well visible, including the recesses 40 that receive the bosses 44 (FIG. 4) of the cover $6^2$. The recesses 40 appear however as protrusions on the rear face of the body $6^1$. The holes receiving the fastening screws (not represented) are also well visible at the centre of each recess 40.

FIG. 5 shows also a series of cavities 50 distributed, in various instances evenly, along a circle centred on the rotation axis of the hand-wheel 6. These cavities 50 are configured for cooperating with an indexing ball urged by a resilient element like a spring. This indexing ball is not visible in FIG. 2 because the cut plane does not pass through it.

FIG. 5 shows also a stop 52 that is configured to cooperate with a corresponding stop on the tap body, for instance with the pin 54 inserted in the body $14^2$ of the tap in FIG. 2. The stop 52 limits the rotation of the hand-wheel and the flow-selector to a little bit less than 360°.

The invention claimed is:

1. A hand-wheel for adjusting at least one of an outlet pressure and a flow-rate of a tap for a gas cylinder, said hand-wheel comprising:
- a body;
- a transparent cover fixed on the body; and
- indicia arranged between the transparent cover and the body so as to be visible by a user but not in contact with the fingers of the user;
- wherein the body comprises a central cavity for housing a gauge or a digital display visible through the transparent cover; and
- wherein the body comprises an outer ring portion forming an annular surface exclusively carrying the indicia.

2. The hand-wheel according to claim 1, wherein the body comprises a front face, at least one of the indicia being arranged on the front face.

3. The hand-wheel according to claim 2, wherein the front face of the body supporting the at least one indicia forms an annular rim portion.

4. The hand-wheel according to claim 1, wherein the transparent cover comprises a front face and a rear face, at least one of the indicia being arranged on the rear face.

5. The hand-wheel according to claim 1, wherein the indicia are printed on at least one of the body and the transparent cover.

6. The hand-wheel according to claim 5, wherein indicia are printed by screen printing.

7. The hand-wheel according to claim 1, wherein the indicia are distributed evenly along a periphery of the hand-wheel.

8. The hand-wheel according to claim 1, wherein the transparent cover is generally disk-shaped with a front face and a rear face, the cover comprising on the rear face at least two bosses configured for receiving threaded portions of fastening screws engaged through holes in the body, from a rear face of the body.

9. The hand-wheel according to claim 8, wherein the body comprises recesses receiving the bosses, respectively.

10. The hand-wheel according to claim 8, wherein the transparent cover comprises on the front face of the cover ribs extending radially, each boss on the rear face of the cover being located in front of one of the ribs.

11. The hand-wheel according to claim 1, wherein the transparent cover comprises at its periphery an annular portion that encircles the body.

12. The hand-wheel according to claim 1, further comprising a gasket extending between the body and the transparent cover at the periphery of the hand-wheel.

13. A tap for gas cylinder, said tap comprising:
- a body with an inlet, an outlet and a passage connecting the inlet with the outlet;
- a device in the passage for varying at least one of the pressure and flow-rate at the outlet, the device comprising a rotating element for adjusting at least one of the pressure and flow-rate; and
- a hand-wheel mounted on the rotating adjusting element of the device, wherein the hand-wheel comprises:
  - a body;
  - a transparent cover fixed on the body; and
  - indicia arranged between the transparent cover and the body so as to be visible by a user but not in contact with the fingers of the user;
- wherein the body comprises a central cavity for housing a gauge or a digital display visible through the transparent cover; and
- wherein the body comprises an outer ring portion forming an annular surface exclusively carrying the indicia.

14. The tap according to claim 13, wherein the body comprises a central cavity for housing a gauge or a digital display visible through the transparent cover, the rotating element of the device is supported by a fixed shaft, and the tap further comprises an electronic indicator with a digital display housed in the cavity of the body of the hand-wheel, and electric wires connected to the indicator and extending through a longitudinal bore in the shaft of the device.

15. A tap assembly, said assembly comprising:
- a tap for gas cylinder; and
- a cover housing the tap, wherein the tap comprises:
- a body with an inlet, an outlet and a passage connecting the inlet with the outlet;
- a device in the passage for varying at least one of the pressure and flow-rate at the outlet, the device comprising a rotating element for adjusting at least one of the pressure and flow-rate;
- a hand-wheel mounted on the rotating adjusting element of the device, wherein the hand-wheel comprises:
  - a body;
  - a transparent cover fixed on the body; and
  - indicia arranged between the transparent cover and the body so as to be visible by a user but not in contact with the fingers of the user; and wherein the cover housing the tap comprises an opening receiving the hand-wheel and a mark on an outer surface of the cover at the edge of the opening, the mark forming a reference for the indicia of the hand-wheel.

* * * * *